United States Patent [19]

Daudi

[11] Patent Number: 4,573,338

[45] Date of Patent: Mar. 4, 1986

[54] METHOD OF WHEEL MANUFACTURE FOR CORRECTING ROTATIONAL NON-UNIFORMITY OF A PNEUMATIC TIRE AND WHEEL ASSEMBLY, APPARATUS FOR PERFORMING SUCH METHOD AND RESULTING WHEEL

[75] Inventor: Anwar R. Daudi, E. Lansing, Mich.

[73] Assignee: Motor Wheel Corporation, Lansing, Mich.

[21] Appl. No.: 615,074

[22] Filed: May 29, 1984

[51] Int. Cl.[4] ..... B21D 53/26; B21D 28/00

[52] U.S. Cl. ..... 72/333; 29/159 R; 83/55; 152/375; 301/63 R

[58] Field of Search ..... 152/375; 83/55, 452, 83/926 R; 29/159 R, 159.01, 159.1; 72/333, 372; 301/63 R

[56] References Cited

U.S. PATENT DOCUMENTS 4,279,287 7/1981 Daudi et al. ..... 29/159 R

*Primary Examiner*—W. D. Bray

*Attorney, Agent, or Firm*—Barnes, Kisselle, Raisch, Choate, Whittemore & Hulbert

[57] ABSTRACT

A method of manufacturing a disc vehicle wheel having both bolt openings and a center pilot opening in the wheel disc wherein the average axis of the wheel bead seats is eccentrically offset from both the bolt hole circle and center hole axes by an amount and in a direction so as to locate a peak of the first harmonic of bead seat radial runout adjacent to a predetermined location on the wheel rim where the disc punch tooling is constructed such that the bolt hole circle and center hole axes are non-coincident. The location of the average bead seat axis is within a zone bounded by the angular range of the peak location with respect to the predetermined location on the wheel rim, and by radii from the bolt and center openings determined by the maximum allowable bead seat eccentricity.

6 Claims, 6 Drawing Figures

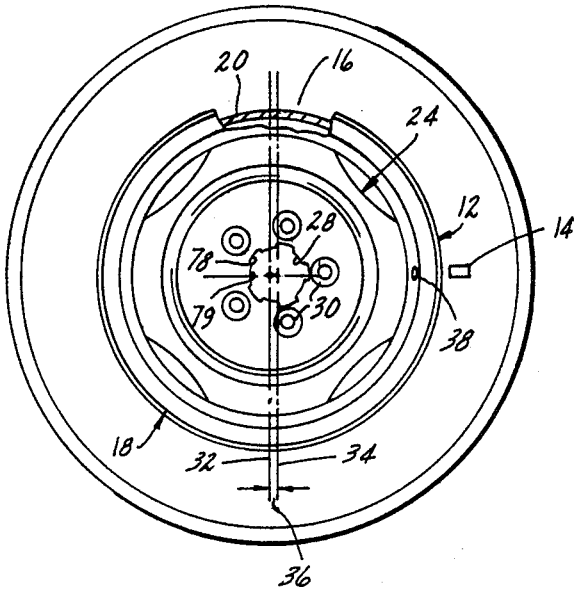
FIG. 1
FIG. 2
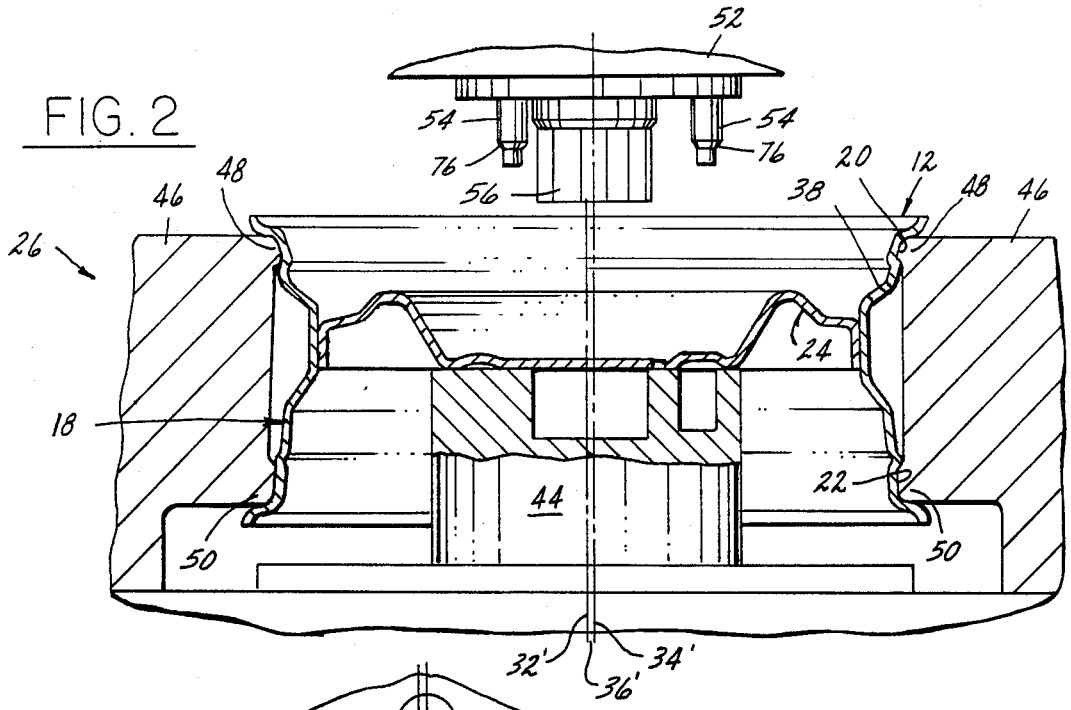
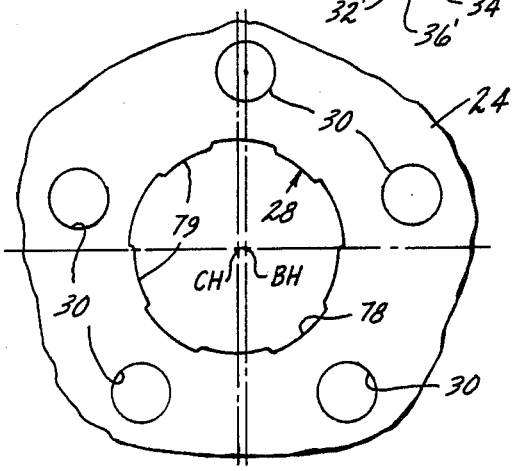
FIG. 6

METHOD OF WHEEL MANUFACTURE FOR CORRECTING ROTATIONAL NON-UNIFORMITY OF A PNEUMATIC TIRE AND WHEEL ASSEMBLY, APPARATUS FOR PERFORMING SUCH METHOD AND RESULTING WHEEL

The present invention relates to the art of vehicle wheel manufacture, and more particularly to correction of variations in radial runout and/or radial force variations in a pneumatic tire and wheel assembly.

A problem long standing in the art lies in the production of pneumatic tires and wheels which, when assembled and operated on a vehicle, run true about their axes of rotation. Forces generated by any circumferential variations in the tire carcass and/or out-of-round conditions in the tire or wheel cause vibrations, which in turn lead to dissatisfied customers and significant warranty claims against automobile manufacturers. The present trend among manufacturers toward higher tire inflation pressures and smaller vehicles to improve fuel economy accentuates this problem, so that uniformity of radial runout and force variation of the tire and wheel assembly has become more critical than in the past.

U.S. Pat. Nos. 4,279,287 and 4,354,407, both assigned to the assignee hereof, address this problem by intentionally forming the bolt-mounting and/or center-pilot openings in the wheel disc at the time of wheel manufacture on an axis which is eccentrically offset from the average axis of the tire bead seats on the wheel rim. This offset is in a direction and amount which is predetermined to locate the low point or high point of the first harmonic of bead seat radial runout circumferentially adjacent to a selected location on the wheel rim. In the preferred embodiments, the low point of the first harmonic of radial runout lies substantially within a quadrant centered about the valve hole in the rim. A pretested tire having the location of the high point of the first harmonic of radial force variation marked thereon may then be assembled onto the wheel such that the respective tire and wheel harmonics are complementary and thereby tend to cancel each other.

In applying the foregoing method in actual production of vehicle wheels, bead seat eccentricity was intiallly specified with respect to the center-pilot or hub opening in the wheel disc by the automotive manufacturer-customer, and application of this technique met with substantial success. There appears to be an absence of consensus, however, as to whether rotational characteristics of a wheel are better specified with respect to the disc center opening which is received over the axle hub or to the disc bolt openings which are received over the mounting studs. It was then deemed desirable by the automotive manufacturer-customer to specify the location and magnitude of the first harmonic of bead seat radial runout with respect to both the bolt hole circle and the center hole. In attempting to meet this specification, it was discovered that a small eccentricity (0.005 inches) in the tooling punches for forming the center and bolt openings can significantly affect the magnitude and location of the first harmonic when the latter is specified with respect to both the center and bolt openings.

It is therefore an object of the present invention to provide a method of manufacturing a vehicle wheel in which the low point or high point of the first harmonic of average bead seat radial runout is eccentrically offset with respect to both the bolt-mounting and center-pilot openings in the wheel disc by an amount and in a direction predetermined to locate the low point or high point of the first harmonic of bead seat radial runout circumferentially adjacent to a selected location on the wheel rim. Another and more specific object of the invention is to provide such a method for use with disc punch tooling wherein the center of the bolt openings and the center of the center-pilot opening are eccentric or non-coincident.

Another object of the present invention is to provide an apparatus for performing such method, and to provide the resulting wheel product.

The invention, together with additional objects, features and advantages thereof, will be best understood from the following description, the appended claims and the accompanying drawings in which:

FIG. 1 is an elevational view of an exemplary pneumatic tire and wheel assembly constructed in accordance with the invetion;

FIG. 2 is a side sectional view illustrating tooling for fabrication, and fabrication of, the wheel in FIG. 1;

FIG. 6 is a fragmentary elevationval view showing the center and bolt hole region of the wheel disc on an enlarged scale.

Referring to FIG. 1, a pneumatic tire 10 is pretested, i.e. prior to assembly onto the steel disc wheel 12, for variations in radial force under dynamic operating conditions. Such testing may be accomplished by a tire manufacturer by mounting and inflating the tire on a test wheel structure, rotating the inflated tire against a load wheel, and measuring the amount and loci of the variations of radial force variation exerted by the tire against the load wheel. The circumferential location of a peak of the first harmonic of radial force variation, i.e. either the high or low point, is then identified by using conventional Fourier analysis techniques, and this location is marked as at 14 in FIG. 1 on the tire side wall near the tire bead 16. For purposes of further discussion, it will be assumed that indicia 14 locates the high point of the first harmonic of radial force variation of tire 10.

Figure 3:
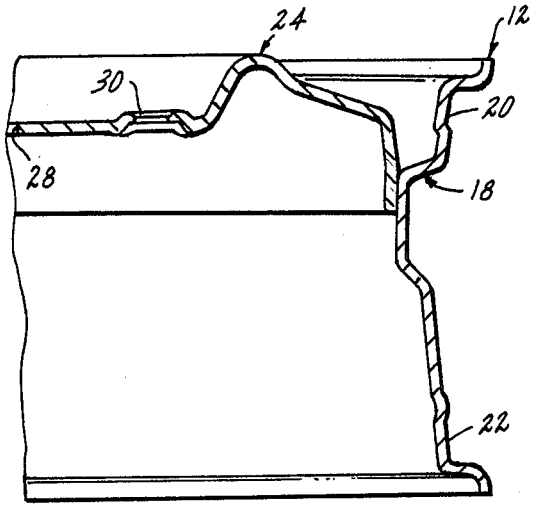
FIG. 3 is a sectional view on an enlarged scale showing the rim and disc contour of the wheel illustrated in FIGS. 1 and 2.

Wheel 12 includes a wheel rim 18 having the usual axially spaced bead seats 20,22 and a disc 24 carried internally of rim 18 for mounting the wheel to a vehicle. Disc 24 and rim 18 are separately manufactured to desired contour using conventional techniques, and are then assembled to each other with disc 24 being permanently attached to the rim as by press-fit and welding or other joining methods. The particular rim and disc contours illustrated in FIGS. 1–3 are for illustrative purposes only and do not form part of the invention.

After the rim and disc have been assembled as described, wheel 18 is placed in a die fixture 26 illustrated semi-schematically in FIG. 2 for the purpose of forming the disc center-pilot opening 28 and the bolt holes 30. In accordance with the technique disclosed in the above-referenced patents, the nominal axial centerline 32 (FIG. 1) of the center hole and bolt hole circle is eccentrically offset from the average centerline or axis 34 of rim bead seats 20,22 by an amount 36 and in a direction empirically calculated to place the low point of the first harmonic of bead seat radial runout with reference to the centers of the center hole and bolt hole circle adjacent to a preselected location on the wheel rim. Preferably, such low point is located substantially within a quadrant which includes the rim valve hole 38, i.e. within the range of 45° on either side of the valve hole which provides a convenient reference on the wheel rims.

In general, the foregoing is accomplished by placing wheel 12 into die fixture 26 such that the central portion of disc 24 rests upon the fixed die block 44. A circumferential array of radially reciprocable jaws 46 is then closed against rim 18 until upper and lower contacts 48,50 on each jaw 46 engage respective bead seats 20,22. Jaws 46 thus firmly engage and fixture wheel 12 to define the location of the average centerline or axis 32 of bead seats 20,22. A punch assembly 52, having a central axis 34, an array of punches 54 for piercing and coining bolt holes 30, and a center punch 56 for piercing and forming centerpilot hole 28, is then lowered against the central portion of disc 24 to pierce and form the bolt and center holes. Under ideal circumstances, the centerline of the circle of bolt hole punches 54 would coincide with the centerline or axis of center hole punch 56, so that bead seat eccentricity with respect to the bolt openings would coincide with or be identical to eccentricity with respect to the center pilot opening. It has been found, however, that manufacturing tolerances in the construction of punch assembly 52 are such that the centerline or axes of the circle of bolt hole punches and center hole punch do not coincide. This has been found to cause difficulties as previously described in construction of wheels wherein bead seat eccentricity and location of the high point or low point of first harmonic are specified with respect to both the center hole and bolt hole axes, and one aspect of the present invention is directed to this problem.

Figure 4:
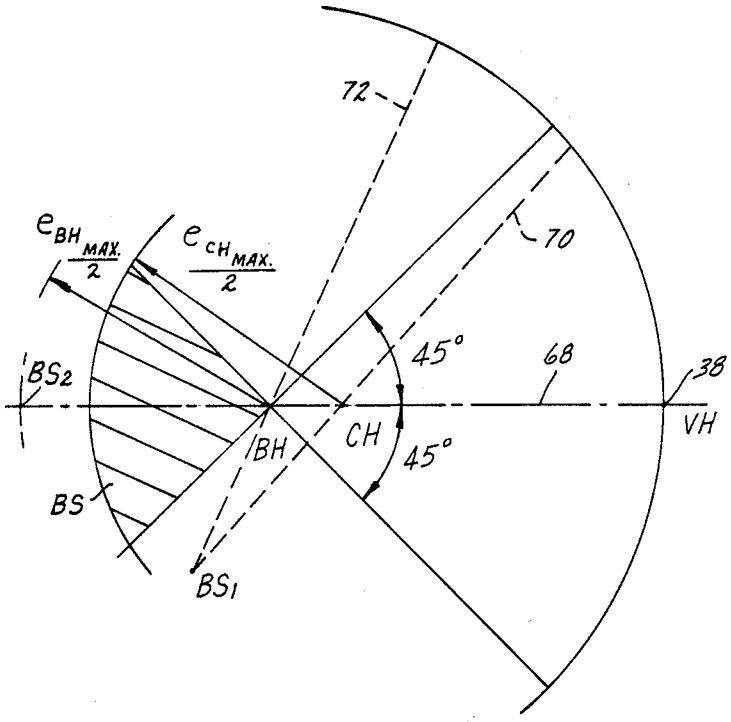
FIGS. 4 and 5 are graphic illustrations useful in describing the principles of the present invention.

FIG. 4 graphically illustrates a situation wherein the centerline or axis BH of bolt hole punches 54 is offset from the centerline or axis CH of center hole punch 56 on a line 68 which includes valve hole VH (38) in the wheel rim. It is also assumed in connection with FIG. 4 that the first harmonic of radial runout of the bead seat with respect to the bolt hole is specified at $e_{BH-MAX}$, that the first harmonic of bead seat radial runout with respect to the center hole is specified at $e_{Ch-MAX}$, and that it is desired to locate the low point of the first harmonic of bead seat radial runout within 45° on either side of the valve hole with respect to both bolt and center holes. In the illustration of FIG. 4, $e_{BH-MAX}$ is equal to $e_{CH-MAX}$. Under these conditions, it is necessary to locate the average bead seat axis within the shaded area BS which is defined by an arc equal to one-half of the maximum allowable bead seat eccentricity centered on the opening axis CH closest to the valve hole, and by straight lines extending from the opening axis BH furthest from the valve hole and oriented at 45° on either side of the line 68 of alignment of the bolt hole and center hole axes. When the bead seat axis is located within the shaded area BS, the first harmonic of bead seat radial runout with respect to center hole CH will be between a maximum of $e_{CH-MAX}$ and a minimum defined by the eccentricity of the center hole and bolt hole axes, i.e. the distance CH−BH in FIG. 4. The first harmonic of bead seat radial runout with respect to the bolt hole center BH will be between a maximum of $e_{BH-MAX}$ minus the distance CH−BH, and a minimum of zero. It has been found that, if these conditions are observed, the location of the low point of the first harmonic will be within the specified 45° range on either side of valve hole VH (38).

If, on the other hand, the average bead seat axis is located outside of the shaded area BS at the location $BS_1$, for example, the magnitude of the first harmonic of radial runout with respect to either the bolt hole or center hole axes will be less than the specified maxim because the point BS, is within the arc $e_{CH-MAX/2}$. Likewise, the location of the low point with respect to center hole CH will be within the 45° range on either side of valve hole VH, as illustrated by the phantom line 70. However, the low point of the first harmonic of bead seat radial runout with respect to bolt hole center BH will be located outside of the 45° range on either side of the valve hole, as illustrated by the phantom line 72. In the same way, location of the average bead seat axis at the position $BS_2$ in FIG. 4 will place the low point of first harmonic within the range of 45° on either side of the valve hole, but would result in a first harmonic magnitude exceeding the limit of eccentricity because the point $BS_2$ is outside of the arc $e_{MAX/2}$ from both center hole CH and bolt hole center BH.

Figure 5:
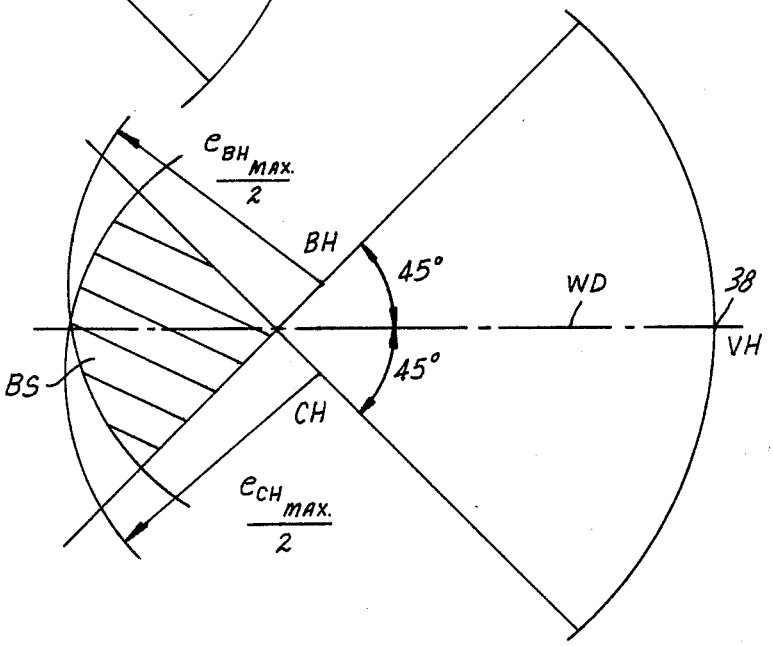

FIG. 5 illustrates another die set-up situation wherein the centerline or axis CH of punch 56 (FIG. 2) is offset from the centerline or axis BH of the circle of punches 54 in a direction perpendicular to a wheel diameter WD through the valve hole VH. In this situation, the shaded area BS is angularly bounded by lines running from points on the bead seat spaced at 45° on either side of the valve hole and respectively intersecting the bolt hole and center hole axes BH and CH. Note that each 45° line intersects the "nearest" center BH or CH—e.g. the center on the associated side of the diameter WD. Radially, the shaded area BS is bounded by arcs centered on the bolt hole and center hole axes and equal to one-half of the maximum specified bead seat. eccentricity with respect to the corresponding axes. As was the case in FIG. 4, location of the average bead seat axis within the shaded area BS in FIG. 5 will result in a bead seat eccentricity less than the maximum allowable eccentricity as measured with respect to either the bolt hole circle or the center hole, and will place the low point of the first harmonic of bead seat radial runout with respect to either the bolt hole circle or the center hole within the quadrant centered on the valve hole.

It will be appreciated that the situations illustrated in FIGS. 4 and 5 represent only two of a wide variety of situations which may be presented in actual practice of the invention. For example, location of the bolt hole and center hole axes BH,CH may be reversed in either of FIGS. 4 and 5, or may be located at an angle with respect to a bead seat diameter which includes the valve hole. In either case, as long as the eccentricity between the bolt hole circle and center hole axes—i.e. the distance BH−CH—is less than the maximum allowable bead seat eccentricity, an area or zone BS may be defined wherein placement of the average bead seat axis will automatically result in a bead seat eccentricity within the allowable magnitude and location specification with respect to either the bolt hole circle or the center hole. It is also possible that bead seat eccentricity may have differing specifications with respect to the bolt hole circle or the center hole axis. It is also possible (and ideally preferable) that the tooling may be constructed such that the bolt hole circle and center hole axes coincide.

Thus, in accordance with the principles of the present invention in their broad aspects where the means for forming the wheel center opening is offset from or non-coincident with the center or axis of the means for forming the mounting openings, and where magnitude and location range of a peak of the first harmonic of bead seat radial runout are specified with respect to both the center opening and mounting openings, the average bead seat axis is located within a zone on the wheel disc bounded by the allowable angular range and by radii from the center and mounting centers equal to one-half of the associated maximum magnitudes. It will be appreciated, of course, in accordance with conventional practice, that the tooling will be set up to locate the average bead seat axis within a more limited zone centered in the broader zoner defined above so that normal or standard deviations in the manufacturing operation will still place the bead seat axis within the broader zone, and thus still resulting in an acceptable wheel.

In practice of the invention during tooling set-up, die jaws 46 (FIG. 2) are first located at a nominal, perhaps centered, position with respect to the axis 34 of reciprocation of punch assembly 52, and a number of wheels 12 are run on the punch and die assembly. These wheels are then checked using conventional equipment for the location and magnitude of the first harmonic of bead seat radial runout with respect to both the center hole and bolt hole circle openings. With these results in hand, the tooling set-up technician may adjust the location jaws 46 in diametrically opposed pairs as described in the aforereferenced patents so as to place the bead seat axis within the zone BS which will result in bead seat radial runout of desired magnitude and location limits with respect to both the center and mounting openings. This may require several set-up and wheel runs depending upon the skill and experience of the set-up technician.

Reciprocation of punch assembly 52 against and through wheel disc 24 in FIG. 2 forms the bolt and center holes as previously described. Preferably, center hole punch 56 is disposed as illustrated in FIG. 2 so as to engage disc 24 prior to bolt hole punches 54, so that the center hole 28 is effectively located and punched prior to punching of the bolt holes. Bolt hole punches 54 include conical shoulder 76 for coining the bolt holes in the usual manner. It has been found that, when center hole 28 is circular, this bolt hole coining operation occasionally distorts the center hole and results in movement of the center hole axis CH from the position which would otherwise be defined by the center hole punch 56. To overcome this problem, center hole punch 56 is serrated or contoured so as to provide a scalloped center opening 28 as shown in FIG. 6. Specifically, center hole 28 preferably comprises an alternating series of radially spaced arcuate segments, with an outer segment 78 being radially aligned with each of the bolt hole openings 30. The center hole axis CH is effectively defined by the inner segments 79, so that distortion of outer segments 78 caused by coining of the bolt holes 30 will not distort inner segments 79 to thereby avoid altering or repositioning the center hole axis.

The invention claimed is:

1. In a method of manufacturing a vehicle disc wheel having a rim with tire bead seats defining an average bead seat axis and a disc with a center hub opening and an array of bolt openings surrounding said center opening, said center and array of bolt openings being centered on axes which are eccentrically offset with respect to said bead seat axis by an amount and in a direction to locate a peak of the first harmonic of bead seat radial runout of said wheel within a predetermined angular range about a preselected location on said rim, said method including the steps of locating said wheel by means of said bead seats and then forming said center and bolt openings in said disc with said array of bolt openings being centered on an axis which is offset with respect to the axis of said center opening, the improvement for locating said peak within said range and maintaining the amplitude of said peak within predetermined limits with respect to both said center and bolt opening array axes, said improvement comprising the step of forming said openings such that said average bead seat axis is located within a zone on said disc bounded by said angular range and by radii from said center and bolt opening array axes equal to said predetermined limits.

2. The method set forth in claim 1 wherein said center and bolt opening array axes are aligned with said predetermined location on said wheel rim, and wherein said angular range of said zone is bounded by straight lines intersecting one of said opening axes and at opposite angles with respect to said aligned axes.

3. The method set forth in claim 2 for locating the low point of said first harmonic of bead seat radial runout adjacent to said preselected location on said rim, wherein said straight lines intersect the one of said opening axes further from said predetermined location.

4. The method set forth in claim 1 wherein said center and bolt opening array axes are not aligned with said predetermined location, and wherein said angular range of said zone is bounded by straight lines at opposite angles with respect to said predetermined location and intersecting respective ones of said opening axes.

5. The method set forth in claim 1 wherein said wheel is a metal disc wheel, wherein said step of forming said openings comprises the steps of punching said openings and coining said bolt openings, and wherein said center opening comprises alternating series of radially spaced inner and outer arcuate segments, said inner segments defining said center hole axis and said outer segments being disposed radially outwardly of said inner segments and aligned radially inwardly of each said bolt opening.

6. The method set forth in claim 1 wherein said step of forming said openings comprises the steps of:

(a) providing an apparatus which includes a plurality of radially reciprocable jaws for engaging the bead seat of a wheel located therein, and punch and die means reciprocable against the disc of a wheel so located for forming said center hub opening and said array of bolt openings in said disc on axes which are offset from each other, (b) adjusting said jaws to position said average bead seat axis of a wheel located in said jaws within said zone bounded by said angular range and by radii from the center opening and bolt opening array axes equal to said predetermined limits, (c) placing a wheel within said jaws and reciprocating said jaws into engagement with the bead seat of said wheel, (d) reciprocating said punch and die means against the disc of said wheel to form said openings, and then (e) removing said wheel from said apparatus.

* * * * *